United States Patent [19]

Spengler

[11] 4,295,178

[45] Oct. 13, 1981

[54] ELECTRODE ARRANGEMENT WITH INDIVIDUALLY CONNECTABLE AND DISCONNECTABLE ELECTRODES

[76] Inventor: Walter Spengler, Strehlgasse 23, CH-4105 Biel-Benken, Switzerland

[21] Appl. No.: 101,642

[22] Filed: Dec. 10, 1979

[30] Foreign Application Priority Data

Feb. 21, 1979 [CH] Switzerland ..... 1709/79

[51] Int. Cl.[3] ..... H01T 19/04

[52] U.S. Cl. ..... 361/220; 361/230

[58] Field of Search ..... 361/212, 213, 220, 225, 361/229, 230

[56] References Cited

U.S. PATENT DOCUMENTS 3,787,722 1/1974 Hatsell ..... 361/225

3,846,150 11/1974 Forgo et al. ..... 361/229 X

*Primary Examiner*—Harry E. Moose, Jr.

[57] ABSTRACT

An electrode arrangement for applying an electrostatic charge to a surface to be sensitized or for removing an electrostatic charge from a surface to be desensitized is provided and comprises a plurality or bank of electrodes which are individually, selectively energizable or de-energizable. More particularly, each electrode in the arrangement comprises an electrode point and contact means spaced from the electrode point with bridging means for selectively connecting and disconnecting the electrode point and contact means and with displaceable insulating means disposed in the path of travel of the bridging means for insulating the contact means from the electrode point while permitting movement of the bridging means to connect the contact means and electrode point.

19 Claims, 7 Drawing Figures

I
III
A
B

ELECTRODE ARRANGEMENT WITH INDIVIDUALLY CONNECTABLE AND DISCONNECTABLE ELECTRODES

FIELD AND BACKGROUND OF THE INVENTION

There are many instances in which it is highly desirable to apply electrostatic charges to surfaces to be sensitized by such charges or to remove electrostatic charges from material surfaces. Electrode arrangements for applying or removing such charges are well known and have been extensively used. In those instances where the entirety of the surface is to be sensitized or is to have the electrostatic charge removed therefrom, such prior electrode arrangements have been quite satisfactory.

However, in many cases, especially in situations where sheet material is moved continuously, it is desirable to remove such electrostatic charges from only individual sections or areas of the moving sheet surface. Also, in many other cases, especially in intaglio or gravure printing applications in which electrostatic charges are used in aiding in the printing process, it is highly desirable to provide the impression cylinder with an electrostatic charge only in those areas in which color is to be transferred between the printing cylinder and the printing substrate. It is also highly desirable that the field strength of the electrostatic charge applied to the impression cylinder be distributed as uniformly as possible for optimal transfer of printing ink from the printing cylinder to the substrate, particularly to obtain the desired inking for semi-tone and ink mixtures.

While known electrode arrangements for sensitizing surfaces by electrostatic charges, e.g. the impression cylinder of a gravure printing press, have included means for controlling the supply voltage with respect to the electrostatic charge being applied to the surface for controlling the field strength and such electrode arrangements do operate satisfactorily in this respect, many of these known electrode arrangements also apply an electrostatic charge to the surface outside of the specific area or areas desired to be sensitized. Such attributes of these known electrode arrangements are undesirable if continuous satisfactory operation is to be obtained. With specific reference to intaglio printing, there are two reasons for this undesirability, namely that the electrostatic charge field tends to progressively widen from the point of application toward the ink transfer zone while the load intensity weakens, and that the impression cylinder surface outside of the area which contacts the substrate experiences a relatively fast buildup of undesirable ink applications. Of course, such undesirable contamination of the impression cylinder surface must be frequently removed through cleaning resulting in interruptions to the printing operation, but also the field or load intensity weakening process increases successively and thus printing quality is impaired.

There have been prior attempts to solve these problems through use of push-on or plug-in type insulating covers which may be used to cover those portions of the electrode arrangement corresponding or opposite the portions of the surface which are not to be charged. However, since the covered electrode points continue to be activated even though covered, the covers themselves become sensitized with an electrostatic charge to an extent that dust and ink may quickly settle on the covers which results in the same undesirable contamination as with the impression cylinder surface. Another prior attempt has suggested an electrode arrangement in which certain electrodes may be individually and selectively energized or de-energized through the use of manually operable contact points. However, such electrodes must be energized or de-energized in a particular sequence or pattern and the activation or deactivation thereof can only be done on an individual and predetermined basis.

BRIEF DESCRIPTION OF THE INVENTION

With the above discussion in mind, it is an object of the present invention to provide an electrode arrangement which overcomes the aforementioned problems and difficulties in previous electrode arrangements particularly with respect to the removal from or application to any limited area of a material surface of an electrostatic charge. In realizing this object of the present invention, an electrode arrangement includes a plurality or bank of electrodes each of which is individually and selectively energizable or de-energizable under the control of the operator in any desired order or sequence. In addition, the electrodes may be connected and disconnected individually or in groups or selectively connected to different supply voltage systems.

Yet a further object of the present invention is to provide an improved electrode arrangement for removing electrostatic charges from any limited area of a material surface or for applying electrostatic charges to such areas, in particular, the impression cylinders of gravure printing apparatus with a very high degree of control over the location and intensity of the electrostatic charge field on the surface being sensitized or desensitized.

BRIEF DESCRIPTION OF FIGURES

Some of the objects of the invention having been stated, other objects will appear as the description proceeds, when taken in connection with the accompanying drawings, in which.

DETAILED DESCRIPTION OF THE INVENTION

While the present invention will be described hereinafter with particular reference to the accompanying drawings, it is to be understood at the outset of the following description that persons skilled in the arts applicable to the present invention will be enabled by this disclosure to construct apparatus which embodies the present invention and yet take forms which may differ from those here particularly described and shown. Accordingly, the description which follows is to be understood broadly as an enabling disclosure directed to persons skilled in the appropriate arts, and is not to be taken as being restrictive upon the scope of the present invention.

Figures 1, 2, 7:
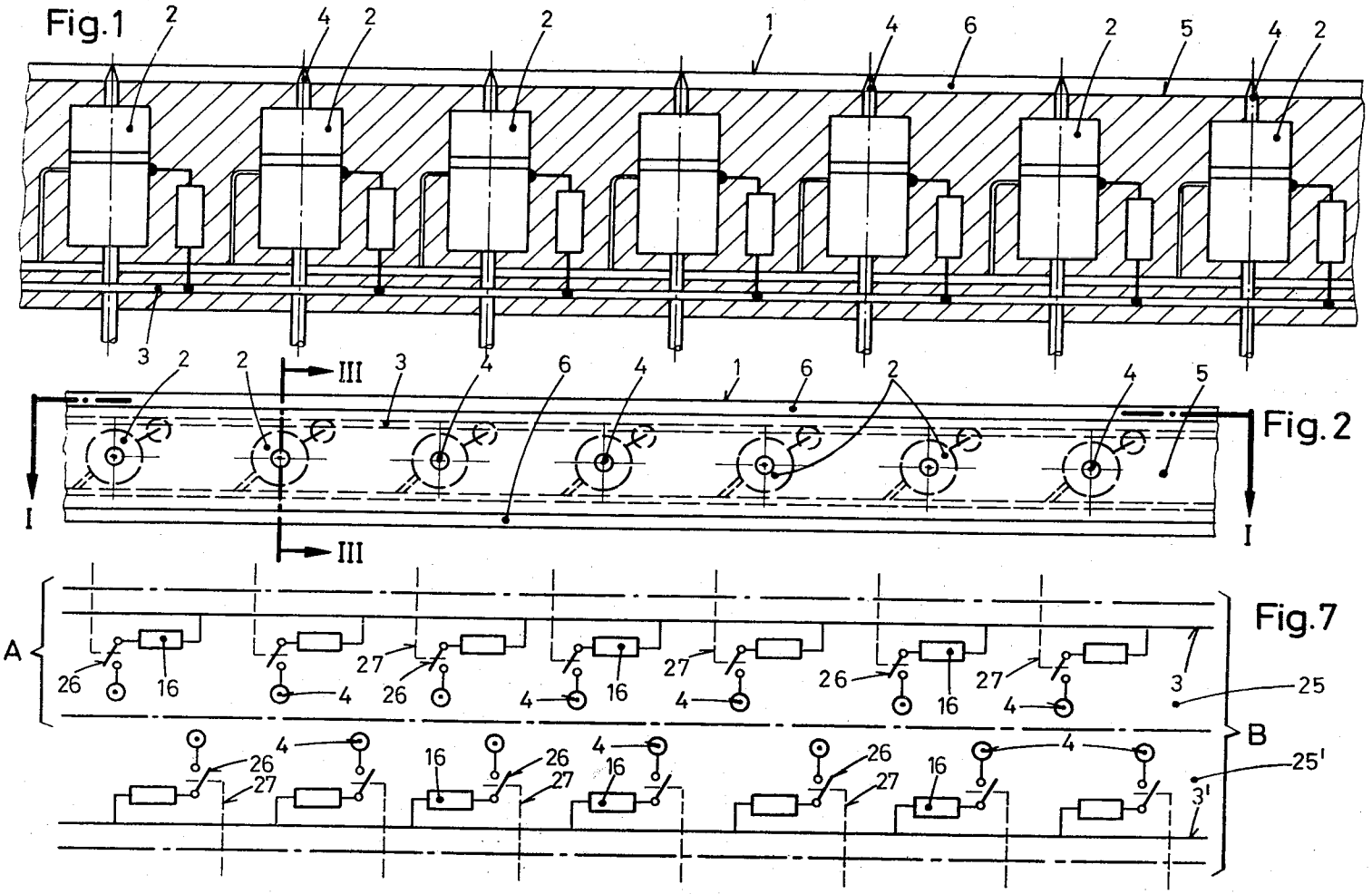
FIG. 1 is a longitudinal section taken along line I—I in FIG. 2 and illustrating the electrode arrangement of the present invention.
FIG. 2 is a plan view of the electrode arrangement shown in FIG. 1.
FIG. 7 is a schematic diagram of electrical circuitry for the electrode arrangements illustrated in FIGS. 1–4 and FIGS. 5 and 6.
Figure 3:
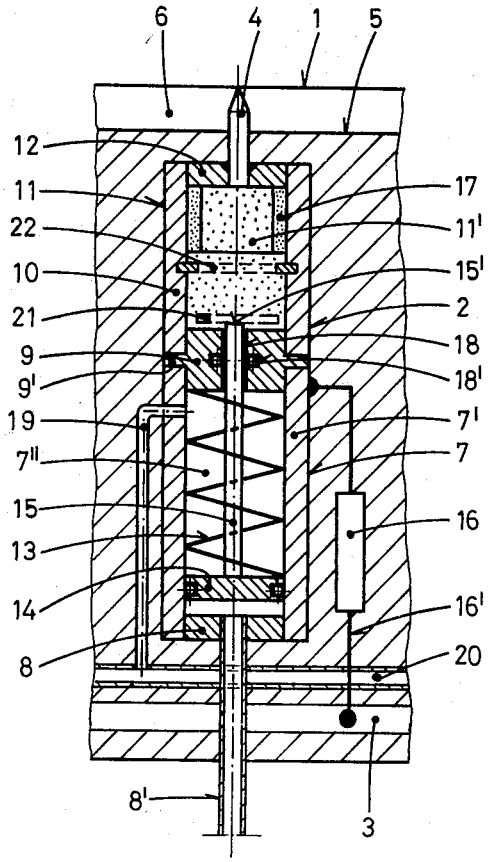
FIG. 3 is an enlarged transverse sectional view taken substantially along line III—III in FIG. 2.

Referring now more particularly to the drawings, the present invention is contemplated as being particularly useful in connection with the impression cylinder of an intaglio or gravure printing press (not shown). A first embodiment of the electrode arrangement of the present invention is illustrated in FIGS. 1–3 and comprises an insulating body 1, preferably formed of cast resin or plastic. Insulating body 1 is mounted by suitable holders (not shown) for positioning adjacent to the surface to which the electrostatic charge is to be applied or from which an electrostatic charge is to be removed.

A plurality or bank of electrodes 2 are carried by insulating body 1 and, in the arrangement illustrated in FIGS. 1–3, electrodes 2 are disposed in a single aligned row extending longitudinally of insulating body 1. The bank of electrodes 2 are supplied with a relatively high voltage by a supply line 3 which in turn is connected to a source of electricity (not shown).

Each of the electrodes 2 comprises a first contact means 4 which is preferably in the form of an electrode point carried by insulating body 1 and having the pointed end thereof projecting outwardly from one side of the insulating body so as to be adapted to be positioned adjacent the surface to which the electrostatic charge is to be applied or from which the electrostatic charge is to be removed. In this connection, insulating body 1 has a U-shaped recess 5 formed in the side thereof from which the electrode points 4 extend with longitudinal protective ribs 6 extending along opposite sides of the recess 5 to protect the points 4. The height of the ribs 6 preferably corresponds substantially to the amount of projection of the electrode points 4 from the bottom of the U-shaped recess 5.

Each of the electrodes 2 also includes a second contact means (to be described specifically hereinafter) which is spaced from the first contact means 4 so as to not normally provide for conduction of electrical energy therebetween. Further, means is provided for bridging the space between the first contact means 4 and the second contact means in a selective and controlled manner so as to selectively energize or de-energize each of the electrodes 2.

In the illustrated embodiment in FIGS. 1–3 and with particular reference to FIG. 3, drive means 7 is illustrated for effecting movement of a bridging member 15 between active and inactive positions. This drive means comprises a pneumatic or hydraulic cylinder-piston assembly 7 comprising a cylinder sleeve 7' having a base plate 8 at one end thereof through which a fluid supply line 8' penetrates. Supply line 8' is connected at its opposite end to a suitable source of pneumatic or hydraulic fluid (not shown). The cylinder sleeve 7' may be constructed of any suitable material, but, as illustrated, the cylinder sleeve is formed of an electrical conductive material such as a metal. At its end opposite the base plate 8, the cylinder sleeve 7' has a cover block 9 which seals the upper end of cylinder sleeve 7' except for a central bore 18 through cover 9. Preferably, cover block 9 is constructed of suitable insulating material and serves to separate drive means 7 from first contact means 4. Bore 18 in cover block 9 receives the upper end of bridging member 15 and serves as a guide therefor. A suitable O-ring seal 18' is provided in bore 18 to form a fluid-tight seal between cover block 9 and bridging member 15.

Cylinder piston assembly 7 also includes a piston 14 mounted for sliding movement within cylinder sleeve 7' and has its outer periphery in fluid-tight sealing engagement with the inner surface of cylinder sleeve 7'. Piston 14 is suitably biased in a direction away from electrode point 4 and toward base plate 8 by a compression spring 13 disposed within cylinder sleeve 7' and between piston 14 and cover block 9.

Bridging member 15 is preferably in the form of a piston rod connected at one end to piston 14 for movement thereby and penetrates axially through compression spring 13. When piston 14 is moved against the biasing action of compression spring 13 by admission of suitable fluid into cylinder sleeve 7' through supply line 8', bridging member 15 is moved therewith upwardly to a position where its upper end 15' establishes electrical contact with electrode point 4. To provide a circuit path leading from supply line 3 to electrode point 4, bridging member 15 is suitably connected to supply line 3 through a coupling element 16 which may be in the form of an ohmic resistor or coupling condenser depending upon the type of electrical voltage source to which supply line 3 is connected. As illustrated, sleeve 7' is of metal and is connected to coupling element 16 and is electrically connected to bridging member 15. If sleeve 7' is of an electrically non-conductive material as is contemplated, then bridging member 15 must be otherwise connected to coupling member 16.

Electrode point 4 is mounted on a contact plate 12 which is carried by the upper end of a shell 10. Shell 10 is mounted at its lower end on cover block 9 by receipt of a cylindrical upper portion of cover block 9 therewithin. Shell 10 is separated from cylinder sleeve 7' by a portion 9' of cover block 9 which functions as an insulating protective collar. Shell 10 defines therewithin a connecting chamber 11 which extends from cover block 9 upwardly to contact plate 12 which closes the upper end of shell 10.

Considering the fact that the supply voltage can range as high as 30 to 40 kilovolts, the space between electrode point 4 and the upper end 15' of bridging member 15 when bridging member 15 is in the inactive position could be such as to inhibit arcing therebetween. Preferably, this spacing should be from 12 to 18 millimeters or approximately $\frac{1}{2}$ to $\frac{3}{4}$ of an inch. For safety reasons, connecting chamber 11 also has a displaceable insulating means 11' therein, which preferably comprises a highly dielectric insulating fluid. As bridging member 15 is moved from the inactive position toward the active position, the displaceable insulating means or fluid 11' will be displaced thereby. To accommodate such displacement, a ring shaped compressible member 17, consisting of rubber foam or the like is provided in the upper portion of connecting chamber 11 to define an expansible portion in the upper end of chamber 11 to provide a substantially constant volume of connecting chamber 11 upon upward movement of bridging member 15 so that no noteworthy pressure increase results in the connecting chamber 11 when the bridging member 15 is moved from the inactive position to the active position. Also, to avoid any changes in pressure in the space within cylinder sleeve 7' upon movement of piston 14 from the lower position to the upper position, the space 7'' within cylinder sleeve 7' above piston 14 is preferably connected through an air duct 19 to an air collection duct 20 suitably extending throughout the entire length of insulating body 1.

In those instances where capacitive coupling of electrode point 4 to supply line 3 is desired, such capacitive coupling can be provided by employing a condenser plate 21 (as shown in FIG. 3 by interrupted lines) on the upper end 15' of bridging member 15. When condenser plate 21 is used, the stroke of the bridging member 15 is limited by a stop plate 22 mounted on shell 10 at a predetermined distance from contact plate 12. Stop 22 should be formed of suitable insulating material if shell 10 is of an electrical conductive material, but may be formed of any suitable material if shell 10 is of a non-electrical conductive material. With this arrangement, the condenser plate 21 moves with the bridging member 15 until it contacts stop 22. The desired capacitive coupling is then provided through the dielectric insulating fluid 11' located between condenser plate 21 and contact plate 12.

In place of stop 22, one or more layers of insulating material may be disposed on the lower side of contact plate 12 or on the upper surface of condenser plate 21. The required spacing between the plates when the condenser plate 21 is moved to the active position would then be provided by such insulating layers.

Where a resistive coupling is desired, ohmic resistor 16 may be replaced by a massive continuous connecting line 16' between the cylinder sleeve 7' and the supply line 3 which would in effect provide distributive resistance throughout the connecting line 16'. Alternatively, suitable electrical resistance spacing means (not shown) may be provided between contact plate 12 and plate 21. Such spacing means may be in the form of a resistor block which would provide the desired spacing while also providing an ohmic resistance coupling between the contact plate 12 and plate 21. In both of these instances, the ohmic resistor 16 could be omitted.

The desired pneumatic or hydraulic fluid operable drive means 7 for moving the bridging member 15 between the inactive and active positions to selectively energize or de-energize the individual electrodes 2 makes it possible, without manipulation of the electrodes themselves, to energize or de-energize any selected one or group of the electrodes from a distant control point or area to vary the area or areas of the surface to which electrostatic charges are applied or from which such charges are removed. It is anticipated that there are certain instances where such remote control is not deemed necessary and cost reasons or other considerations might dictate that the fluid operable drive means would not be required.

Figure 4:
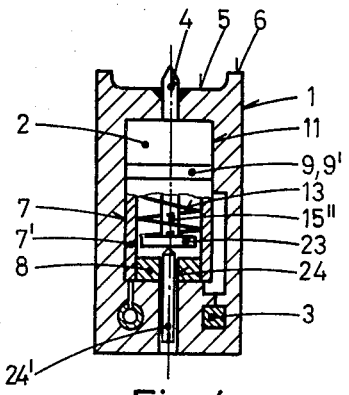
FIG. 4 is a transverse sectional view similar to FIG. 3 but on a reduced scale and illustrating another embodiment of the electrodes forming the electrode arrangement of the present invention.

Accordingly, it is contemplated by the present invention that a manually operable means for effecting movement of the bridging element 15 from the inactive position to the active position may be employed. Specifically, such manually operable means is illustrated in FIG. 4 wherein like reference characters are used to denote like structural elements. In this embodiment, the fluid operable means is omitted although the sleeve 7', base plate 8 and cover block 9 are retained. A centering disc 23 is substituted for piston 14 on the lower end of bridging element 15. To provide for movement of centering disc 23 and bridging member 15, the fluid supply line 8' is omitted and the hole or bore through the base plate 8 and the lower portion of insulating body 1 is internally tapped as indicated at 24. A set screw 24' is threadably received in tapped hole 24 and has its upper end in contact with centering disc 23. Therefore, upon suitable rotation of set screw 24', centering disc 23 and bridging member 15 are moved upwardly to the active position. Upon rotation of the set screw 24' in the opposite direction, the spring 13 will return the bridging member 15 to the inactive position. While illustrated in FIG. 4, the fact that centering disc 23 is not in fluid-tight sealing engagement with the sleeve 7' makes the air duct and air collection duct (19,20 in FIG. 3) unnecessary and such can therefor be omitted.

At this point, it should be noted that not all of the electrodes 2 need to be connected to the same or a single supply line 3. Rather, it is possible to arrange the electrodes 2 in any desired arrangement and connected to the same or multiple sources to provide for different effects. For example, electrodes 2 may be each connected to an individual supply line or in groups with each group connected to a different electrical source.

In addition, the electrodes 2 may be mounted in any suitable manner within insulating body 1 such as by being integrally cast therein or by means of recessed openings formed in the cast body which would permit replacement of individual electrodes should such become necessary. Additionally, the bank of electrodes 2 are preferably uniformly distributed within the insulating body 1 but may be arranged in a single row as illustrated in FIGS. 1 and 2 or in multiple rows as desired. Specifically, in FIGS. 5 and 6 a double row of electrodes 2 are illustrated with each row having a separate supply line 3 for supplying the individual electrodes with voltage.

Figure 5:
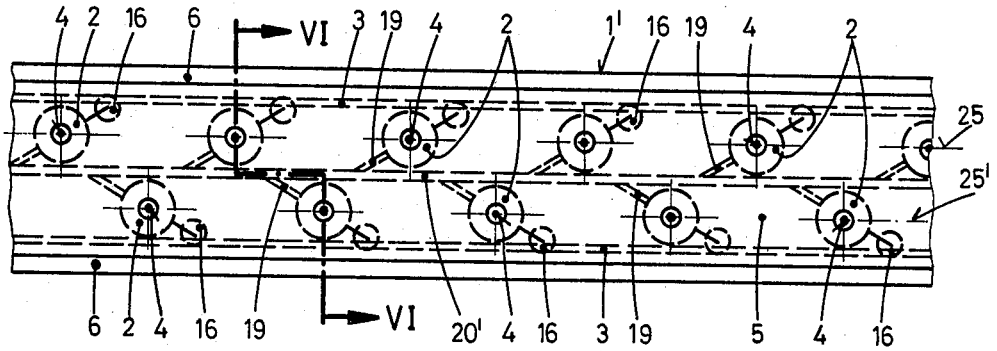
FIG. 5 is a fragmentary top plan view similar to FIG. 2 of an electrode arrangement with multiple rows of electrodes therein.
Figure 6:
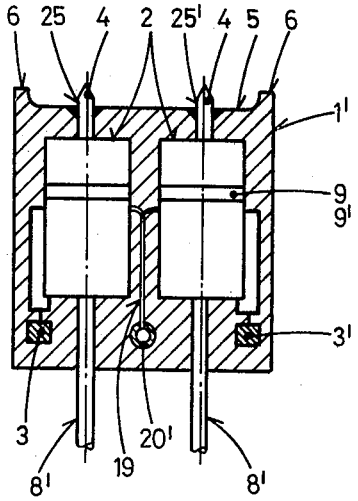
FIG. 6 is a transfer sectional view taken substantially along line VI—VI in FIG. 5.

In the embodiment illustrated in FIGS. 5 and 6, the electrodes are arranged in two rows 25,25' with the individual electrodes 2 in each row being longitudinally aligned along insulating body 1'. The individual electrodes 2 may be in either the form illustrated in FIG. 3 or as illustrated in FIG. 4, although in FIG. 6 the electrodes are illustrated as having a form like that shown in FIG. 3. Unless specifically stated otherwise, like reference characters are used in FIGS. 5 and 6 as were used in FIGS. 1-4 to identify identical parts.

While only two rows of the electrodes 2 are shown in FIGS. 5 and 6, it is specifically contemplated that more than two rows in a single insulating body may be provided and while the electrodes are shown as being connected to separate supply lines 3, all rows could be connected to a single supply line or the electrodes within each row may be individually and separately supplied, or may be divided into suitable groups of electrodes separately supplied. Similarly, the electrodes in multiple rows could be grouped together and separately supplied with suitable supply lines. In the arrangement illustrated in FIGS. 5 and 6, a single air collection duct 20' is provided for all of the electrodes 2 and the individual electrode air ducts 19 are connected to such common air collection duct 20'.

Referring now to FIG. 7, there are illustrated therein two wiring diagrams with the uppermost wiring diagram encompassed within the bracket A being applicable to a single row electrode arrangement, such as is illustrated in FIGS. 1-4, whereas the wiring diagram encompassed within the bracket B is applicable to a double row electrode arrangement as illustrated in FIGS. 5 and 6. In the wiring diagram illustrated in FIG. 7, the same reference characters are used to indicate like elements as are used in the other figures of the drawing with the exception that the contact means provided by the contact plate 12, bridging member 15 and sleeve 7' are illustrated as a switch 26 in FIG. 7 and the drive means for actuating the bridging member for movement between the inactive position and active position is symbolized by dotted lines 27. It can be readily appreciated that by a specific two-way arrangement of the electrodes 2 and their coordination with specific supply systems, very differentiated results concerning the electrostatic charge arrangement and the intensity of the electrostatic fields can be provided in a very expedient manner.

This invention has been described in terms wherein spaced first and second contact means are defined by electrode point 4 and its associated contact plate 12 and by cylinder sleeve 7' with a movable bridging member 15 to establish contact therebetween. Since bridging member 15 is in electrical conductive relation to sleeve 7' at all times, the upper end 15' of bridging member 15, with or without plate 21, could be considered as a movable second contact means which is moved into and out of electrical conductive relation with first contact means 4,12. Such an arrangement is specifically contemplated by this invention.

That which is claimed is:

1. In an electrode arrangement for applying or removing an electrostatic charge to or from a surface and comprising a plurality of electrodes adapted to apply to or receive from the surface an electrostatic charge, and insulating body means mounting the plurality of electrodes in a predetermined arrangement for positioning in operative association with the surface to which the charge is to be applied or from which the charge is to be removed, the improvement in said arrangement in which each of said electrodes comprises an electrode point carried by said insulating body means and projecting outwardly therefrom and adapted to be positioned adjacent said surface, contact means carried by said insulating body means in spaced relation to said electrode point and adapted to be connected to an electrical supply source or to ground, and connecting means carried by said insulating body means for selectively connecting and disconnecting said electrode point and said contact means, said connecting means comprising an electrically conductive bridging member electrically connected to one of said electrode point and said contact means and mounted for movement between an active position in which said bridging member is in electrical contact with the other of said electrode point and said contact means to bridge the space therebetween and to provide for the flow of an electrical current therebetween and an inactive position in which said bridging member is spaced from the other of said electrode point and said contact means, means operably associated with said bridging member for selectively moving said bridging member between said active and inactive positions, and displaceable insulating means positioned in the path of travel of said bridging member from said inactive position to said active position for insulating said bridging member from the other of said electrode point and said contact means when said bridging member is in said inactive position while permitting movement of said bridging member to said active position.

2. An electrode arrangement according to claim 1 wherein said means for moving said bridging member between said active and inactive positions includes means biasing said bridging member toward said inactive position, and drive means for moving said bridging member to said active position against the action of said biasing means.

3. An electrode arrangement according to claim 2 wherein said drive means comprises a fluid operable cylinder-piston assembly.

4. An electrode arrangement according to claim 3 wherein said fluid operable assembly is a pneumatic cylinder-piston assembly.

5. An electrode arrangement according to claim 3 wherein said fluid operable assembly is a hydraulic cylinder-piston assembly.

6. An electrode arrangement according to claim 2 wherein said drive means comprises manually operable screw means accessibly mounted in said insulating body means and operably connected to said bridging member.

7. In an electrode arrangement comprising a bank of electrodes and insulating body means mounting the bank of electrodes in a predetermined arrangement for positioning in operative association with a surface, the improvement in said arrangement in which each of said electrodes comprises an electrode point carried by said insulating body means and projecting outwardly therefrom and adapted to be positioned adjacent said surface, contact means carried by said insulating body means in spaced relation to said electrode point and adapted to be connected to an electrical supply source or to ground, and connecting means carried by said insulating body means for selectively connecting and disconnecting said electrode point and said contact means, said connecting means comprising an electrically conductive bridging member electrically connected to said contact means and mounted for movement between an active position in which said bridging member is in electrical contact with said electrode point to provide for the flow of an electrical current between said contact means and said electrode point and an inactive position in which said bridging member is spaced from said electrode point, means for biasing said bridging member toward said inactive position, drive means operably associated with said bridging member for selectively moving said bridging member from said inactive position to said active position and insulating means positioned in the path of travel of said bridging member from said inactive position to said active position for insulating said bridging member from the other of said electrode point and said contact means when said bridging member is in said inactive position while permitting movement of said bridging member to said active position.

8. An electrode arrangement according to claim 7 wherein said drive means for said bridging member comprises a pneumatic or hydraulic fluid operable cylinder-piston assembly and wherein said bank of electrodes are individually controlled through said assemblies.

9. An electrode arrangement according to claim 7 wherein said drive means for said bridging member comprises a pneumatic or hydraulic fluid operable cylinder-piston assembly and wherein said bank of electrodes are controllably divided into groups for selective activation or deactivation.

10. An electrode arrangement according to claim 7 wherein said drive means for said bridging member comprises a cylinder operably connected at one end thereof to a source of pneumatic or hydraulic fluid and a piston slidably mounted within said cylinder with the outer periphery thereof in sealing engagement with the interior of said cylinder, and further wherein said bridging member comprises a rod connected to said piston and projecting through the other end of said cylinder toward said electrode point.

11. An electrode arrangement according to any of claims 7–10 wherein said insulating means comprises a highly dielectric insulating fluid.

12. In an electrode arrangement comprising a bank of electrodes, and insulating body means mounting the bank of electrodes in a predetermined arrangement for positioning in operative association with a surface, the improvement in said arrangement in which each of said electrodes comprises an electrode point carried by said insulating body means and projecting outwardly therefrom and adapted to be positioned adjacent said surface, contact means carried by said insulating body means in spaced relation to said electrode point and adapted to be connected to an electrical supply source or to ground, and connecting means carried by said insulating body means for selectively connecting and disconnecting said electrode point and said contact means, said connecting means comprising an electrically conductive bridging member electrically connected to said contact means and mounted for movement between an active position in which said bridging member is in electrical contact with said electrode point to provide for the flow of an electrical current between said electrode point and said contact means and an inactive position in which said bridging member is spaced from said electrode point, drive means operably associated with said bridging member for selectively moving said bridging member from the inactive position to the active position comprising a cylinder connected at one end to a source of pneumatic or hydraulic fluid and a piston slidably mounted in said cylinder with the outer periphery of said piston in sealing engagement with the interior of said cylinder, said bridging member comprising a rod connected at one end to said piston and penetrating through the other end of said cylinder toward said electrode point, a compression spring disposed between said piston and said other end of said cylinder and surrounding said bridging member for biasing said bridging member toward the inactive position, a highly dielectric insulating fluid positioned in the path of travel of said bridging member from said inactive position to said active position for insulating said bridging member from said electrode point when said bridging member is in said inactive position while permitting movement of said bridging member to said active position, and means defining an expansible chamber for confining said insulating fluid while permitting displacement thereof upon movement of said bridging member from the inactive position to the active position.

13. An electrode adapted to apply or remove an electrostatic charge to or from a surface and comprising first contact means including an electrode point adapted to be positioned adjacent said surface, second contact means adapted to be connected to an electrical supply source or to ground, first insulating means mounting said first and second contact means in spaced relation, and connecting means for selectively connecting and disconnecting said electrode point and said contact means, said connecting means comprising an electrically conductive bridging member electrically connected to one of said first and second contact means and mounted for movement between an active position in which said bridging member is in electrical contact with the other of said contact means to provide for the flow of an electrical current therebetween and an inactive position in which said bridging member is spaced from the other of said contact means, means biasing said bridging member toward the inactive position, drive means operably associated with said bridging member for selectively moving said bridging member from said inactive position to said active position, and displaceable second insulating means positioned in the path of travel of said bridging member from said inactive position to said active position for insulating said bridging member from the other of said electrode point and said contact means when said bridging member is in said inactive position while permitting movement of said bridging member to said active position.

14. An electrode according to claim 13 wherein said drive means comprises a pneumatic or hydraulic fluid operable cylinder-piston assembly.

15. An electrode according to claim 13 wherein said drive means comprises manually operable screw means connected to said bridging member and accessible from the outside of said electrode.

16. An electrode according to any of claims 13–15 wherein said displaceable insulating means comprises a highly dielectric insulating fluid.

17. An electrode according to any of claims 13–15 wherein said displaceable insulating means comprises a highly dielectric insulating fluid and including means defining an expansible chamber for confining said insulating fluid while permitting displacement thereof upon movement of said bridging member from the inactive position to the active position.

18. In an electrode arrangement for applying or removing an electrostatic charge to or from a surface and comprising a plurality of electrodes adapted to apply to or receive from the surface an electrostatic charge, and insulating body means mounting the plurality of electrodes in a predetermined arrangement for positioning in operative association with the surface to which the charge is to be applied or from which the charge is to be removed, the improvement in said arrangement in which each of said electrodes comprises an electrode point carried by said insulating body means and projecting outwardly therefrom and adapted to be positioned adjacent said surface, contact means adapted to be connected to an electrical supply source or to ground and mounted in said insulating body means for movement between an active position in which said contact means is in electrical contact with said electrode point to provide for the flow of an electrical current therebetween and an inactive position in which said contact means is spaced from said electrode point, means operably associated with said contact means for selectively moving said contact means between said active and inactive positions, and displaceable insulating means positioned in the path of travel of said contact means from said inactive position to said active position for insulating said contact means from said electrode point when said contact means is in said inactive position while permitting movement of said contact means to said active position.

19. In an electrode arrangement for applying or removing an electrostatic charge to or from a surface and comprising a bank of electrodes adapted to apply to or receive from the surface an electrostatic charge, and insulating body means mounting the bank of electrodes in a predetermined arrangement for positioning in operative association with the surface to which the charge is to be applied or from which the charge is to be removed, the improvement in said arrangement in which each of said electrodes comprises an electrode point carried by said insulating body means and projecting outwardly therefrom and adapted to be positioned adjacent said surface, contact means carried by said insulating body means in spaced relation to said electrode point and adapted to be connected to an electrical supply source or to ground, and connecting means carried by said insulating body means for selectively connecting and disconnecting said electrode point and said contact means, said connecting means comprising an electrically conductive bridging member electrically connected to said contact means and mounted for movement between an active position in which said bridging member is in electrical contact with said electrode point to provide for the flow of an electrical current between said electrode point and said contact means and an inactive position in which said bridging member is spaced from said electrode point, drive means operably associated with said bridging member for selectively moving said bridging member from the inactive position to the active position comprising a cylinder connected at one end to a source of pneumatic or hydraulic fluid and a piston slidably mounted in said cylinder with the outer periphery of said piston in sealing engagement with the interior of said cylinder, said bridging member comprising a rod connected at one end to said piston and penetrating through the other end of said cylinder toward said electrode point, and a compression spring disposed between said piston and said other end of said cylinder and surrounding said bridging member for biasing said bridging member toward the inactive position.

* * * * *